US006821035B2

(12) United States Patent
Gemmell

(10) Patent No.: US 6,821,035 B2
(45) Date of Patent: Nov. 23, 2004

(54) LINE PRINTER WITH STAGGERED MAGNETICS

(75) Inventor: John W. Gemmell, Aliso Viejo, CA (US)

(73) Assignee: Printronix, Inc., Irvine, CA (US)

( * ) Notice: Subject to any disclaimer, the term of this patent is extended or adjusted under 35 U.S.C. 154(b) by 87 days.

(21) Appl. No.: 10/119,557

(22) Filed: Apr. 10, 2002

(65) Prior Publication Data

US 2003/0192440 A1 Oct. 16, 2003

(51) Int. Cl.[7] ..... B41J 3/12

(52) U.S. Cl. ..... 400/124.17; 400/124.19; 400/124.2; 400/124.23; 101/93.05

(58) Field of Search ..... 400/124.16, 124.17, 400/124.18, 124.19, 124.2, 124.21, 124.22, 124.23, 124.01; 101/93.05

(56) References Cited

U.S. PATENT DOCUMENTS

| | | | | |
|---|---|---|---|---|
| 3,285,166 A | | 11/1966 | Helms et al. | |
| 3,719,139 A | | 3/1973 | Niccolai | |
| 3,983,806 A | | 10/1976 | Ishi | |
| 4,214,836 A | * | 7/1980 | Wang | 400/124.23 |
| 4,497,110 A | | 2/1985 | Jezbera | |
| 4,699,051 A | | 10/1987 | Jezbera | |
| 4,895,464 A | * | 1/1990 | Rubinshtein | 400/124.18 |
| 5,290,113 A | * | 3/1994 | Andoo et al. | 400/124.17 |
| 5,344,242 A | * | 9/1994 | Farb | 400/124.2 |
| 6,000,330 A | * | 12/1999 | Farb et al. | 101/93.04 |

FOREIGN PATENT DOCUMENTS

| | | |
|---|---|---|
| EP | 0601376 | 6/1994 |
| JP | 05038821 | 2/1993 |

* cited by examiner

*Primary Examiner*—Andrew H. Hirshfeld
*Assistant Examiner*—Kevin D. Williams
(74) *Attorney, Agent, or Firm*—MacPherson Kwok Chen & Heid LLP; Tom Chen

(57) ABSTRACT

An impact printer with a hammerbank having print hammers retained by a permanent magnet for impacting a print ribbon, and a mechanical driver for moving the hammerbank across print media. First and second coils for each hammer are wrapped around first and second pole pieces, one of which is asymmetrical to the other pole piece. One of the pole pieces can have a generally elongated longitudinal form with the coil wound around the longitudinal form and the other can have a generally arcuate form, with the coil wrapped on a portion between the ends thereof. The coil wrapped around the arcuately formed pole piece is thicker than the coil wrapped around the longitudinal pole piece. The result is to provide pole pieces and coils for an impact printer having differing spatial relationships that can be staggered, or formed asymmetrically for more compact coil and pole piece placement to improve printer efficiency.

10 Claims, 6 Drawing Sheets

42
54
102
108
116
126
100
94
68
98
84
88
46
70
96
80
98
86
72
200
90
110
78
100
118
74
128
104
52
58
60
64

LINE PRINTER WITH STAGGERED MAGNETICS

BACKGROUND OF THE INVENTION

1. Field of the Invention

The field of this invention lies within the impact printer art. It lies more particularly with regard to impact printers that can place a dot matrix configuration on an underlying media by the impact of a print ribbon which prints on the media such as paper. The dot matrix configuration is provided by a hammerbank having multiple hammers with tips thereon that impact the print ribbon for printing on the paper. Such hammers are known to be retained by permanent magnets which are in associated relationship to the hammers for retaining them through their permanent magnetic force until they are released. Release of the hammers is accomplished by electro-magnetics that overcome the permanent magnetism so that the hammers are fired in a desirable sequence for providing a dot matrix configuration. The release of the hammers through the electro-magnetics is by means of coils which are generally wrapped around pole pieces. This invention specifically relates to the configuration and placement of such coils and pole pieces.

2. Prior Art

Impact printers of the prior art have incorporated banks of hammers with printing tips collectively referred to as a hammerbank. The hammers on the hammerbank are generally mounted in a row along the longitudinal relationship of the hammerbank. Such printers are often specifically referred to as line printers.

Each hammerbank usually has one or more permanent magnets for retaining the hammers until they are fired or released. The retention is generally enhanced by a pole piece or pole pieces which create a magnetic circuit for retaining the hammers in a permanent magnetically retained condition until fired or released by the coils.

The pole pieces are mounted in the hammerbank. They form magnetically oriented circuits to allow for the magnetism from the permanent magnets to be oriented in a manner to pull the hammers back into close contact or in contact with the pole piece ends.

Each pole piece generally has a coil wrapped around it. These pole pieces with their coils are in electro-magnetically connected relationship.

The pole piece windings or coils terminate at certain terminals. The terminals are in turn connected to what are referred to as hammer drivers. These respective hammer drivers are in the form of transistors or other power drivers in order to provide a given current or voltage through the coils to overcome the permanent magnetism. In overcoming the permanent magnetism, the hammers are then released for impact against a ribbon which prints on an underlying media.

The prior art generally has placed pole pieces with their coils such that they are symmetrically placed along the hammerbank. The pole pieces are oftentimes encapsulated in part within a bobbin that constitutes a plastic or other non-conductive material around the pole pieces which in turn can have the coil windings wrapped thereon.

The proximity of the pole pieces with their coils wrapped around them have a limiting effect as to their adjacent placement. In consideration of the fact that it is desirable to have pole pieces as close together as possible while not creating magnetic interference, the symmetrical pole pieces of the prior art have limited the placement. This is because of the fact that when windings around each respective pole piece are placed in adjacent relationship to another pole piece, the thickness of the winding limits the placement. When the windings extend into close proximity with another winding, it is difficult for them to be increased in their dimensions, such as thickness.

The greater number of turns of a given wire gauge provide for greater electromagnetic forces. It is customary to try to optimize the number of windings on each pole piece to the largest practical amount without them interfering either physically or electro-magnetically with another set of windings. The prior art has limited the proximity of the respective windings. When a certain width is reached, it can not be extended any further without displacing the adjacent pole pieces, thereby decreasing the amount of hammers and effectiveness of the hammerbank.

This invention enables greater amounts of wire to be wound around each respective pole piece in closer proximity than in the prior art. To this extent, the windings also with their placement provide less magnetic interaction.

The increased number of coils allows for increased hammers on a hammerbank so that faster printing can take place. The orientation is such where it provides for coil overlapping, staggered displacement, or spatially displaced orientations with regard to the respective coils without increasing the width, spacing, or gaps between the hammers.

Coil losses are generally the bulk of power losses that take place in the drivers as to the power required to drive the coils. With this in mind, when increased winding can be accomplished in the same given space or less space, the power losses decrease. When the power losses decrease, more accurate printing takes place due to the overall rapidity and response of the hammerbanks.

The net result of the invention is that one can use larger gauge wire with fewer windings or lesser gauge wire with greater windings. To the contrary, the increased dimensions of the prior art that cause the pole pieces to be extended from each other or spaced at a further point diminish the overall effectiveness or efficiency of the hammerbanks.

It has been found that in hammerbanks of approximately thirteen and one half (13½) inches in length, that this invention allows one hundred and twenty six (126) print hammers as opposed to one hundred and two (102) in the same length of the prior art. This is an approximate twenty five percent (25%) increase in the number of hammers creating greater efficiency.

The magnetic efficiency of the hammerbank provides for other benefits. Such benefits can be in the form of eliminating lamination of the pole pieces due to the higher efficiency. Lamination can also be in lesser multiple laminates because the reduced coil losses more than offset any power losses due to eddy currents. In this regard, as to the pole pieces, cheaper materials and construction can be used for the pole pieces thereby decreasing the overall costs while at the same time increasing efficiency.

The invention relies upon the concept of staggering or spatially varying the respective pole pieces and coils. Every other one is in a symmetrically placed manner with the ones in between adopting a different configuration or placement. When adopting this different configuration, the pole pieces allow a greater amount of windings. The windings are placed on the pole pieces so that the coil of one leg is interposed between the coil of the adjacent magnetic circuit.

The geometrical staggering or orientation of orienting windings so that they can be placed in close proximity to each other with less magnetic interference enhances the overall operation of the pole pieces from an electromagnetic standpoint. At the same time the improved magnetics and interposing coils allow for greater spatial density. These improvements will be seen in the specification hereafter.

SUMMARY OF THE INVENTION

In summation, this invention comprises a line printer having a hammerbank with a plurality of hammers retained thereon by permanent magnets that are released from the permanent magnets by an improved interposing series of coils wrapped around pole pieces that serve to create a magnetic circuit; each pole piece having a staggered relationship or geometrically offset spatial relationship for establishing greater amounts of windings on each given pole piece.

More specifically, the invention incorporates a hammerbank having a row of hammers mounted thereon. Each of the hammers is retained by permanent magnetism. In order to complete the permanent magnetic circuit, pole pieces are in magnetic orientation to the permanent magnets and the hammers to complete the circuit.

Each of the pole pieces has a winding around it of a given amount of turns. In order to enhance the amount of turns, the pole pieces are staggered or asymmetrically oriented for increased winding between each respective adjacent pole piece. This is accomplished by having one pole piece being spaced from another through a dog leg offset, staggered, removed, or other configuration so that one pole piece can have a winding extending along its length a given distance and amount without interfering with another pole piece. In effect a differing spatial relationship between pole pieces is established to provide for a greater number of turns around each pole piece.

The foregoing orientation between pole pieces can be accomplished by dog legs, offsets, geometric angular orientations, asymmetry, or any other suitable geometry or spatial relationship to maintain a substantial amount of windings in proximity to each other which are greater in number than could be accomplished without the improved geometric orientation.

DETAILED DESCRIPTION OF THE PREFERRED EMBODIMENTS

Figure 1:
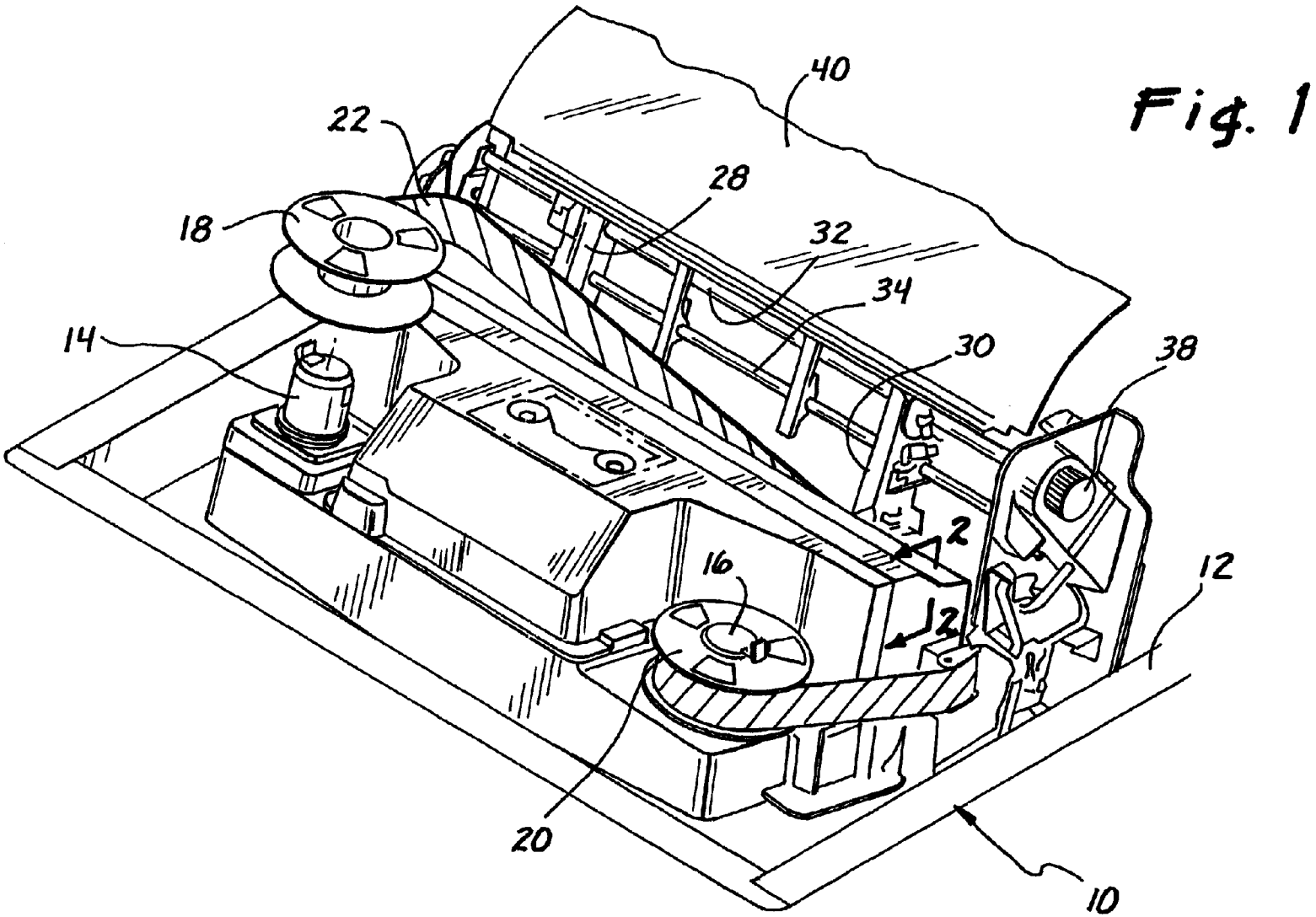
FIG. 1 shows a fragmented perspective view of a line printer of this invention.

Looking more specifically at FIG. 1, it can be seen that a line printer 10 has been shown. The line printer 10 has a frame 12 supporting the line printer. It should be understood that the line printer can be in a cabinet or mounted for relative portability on a stand or other mountings. Regardless of the way the line printer 10 is mounted, the principals of this invention are relatively the same.

Looking more specifically at the line printer 10, it can be seen that a pair of ribbon hubs 14 and 16 are shown. These ribbon hubs 14 and 16 provide a support and drive for ribbon spools 18 and 20, ribbon spools 18 and 20 are mounted respectively on the hubs 14 and 16.

Any particular type of print ribbon can be used with this invention as well as methods of feeding and passing a ribbon or other impact receiving flexible member having ink in order to impact against an underlying media such as paper. Any type of suitable media can be printed upon such as paper, plastic sheet, composite sheets, or bar code labels. In this particular instance, a ribbon 22 is shown wound around the respective spools 18 and 20. These ribbon spools in the showing are such wherein spool 18 is being emplaced on the hub 14 and spool 20 is already on its respective hub 16.

The ribbon 22 traverses backwardly and forwardly by being driven by the hubs 14 and 16. As it traverses backwardly and forwardly hammers, having tips impact the ribbon 22 and the underlying media.

In order to feed the media such as paper, a pair of tractors 28 and 30 move the paper along a direction across the face of the hammerbank to be described hereinafter. The tractors 28 and 30 are driven by a splined rod 32 which engages the tractors. In order to support the tractors 28 and 30 a tractor support shaft 34 is utilized. The paper or other printable media can be advanced or retracted by a knurled knob 38 which turns the tractor drive.

The paper or other media, is supported by a paper feed shield 40. This paper feed shield 40 supports the paper or other media as it moves along.

Figure 2:
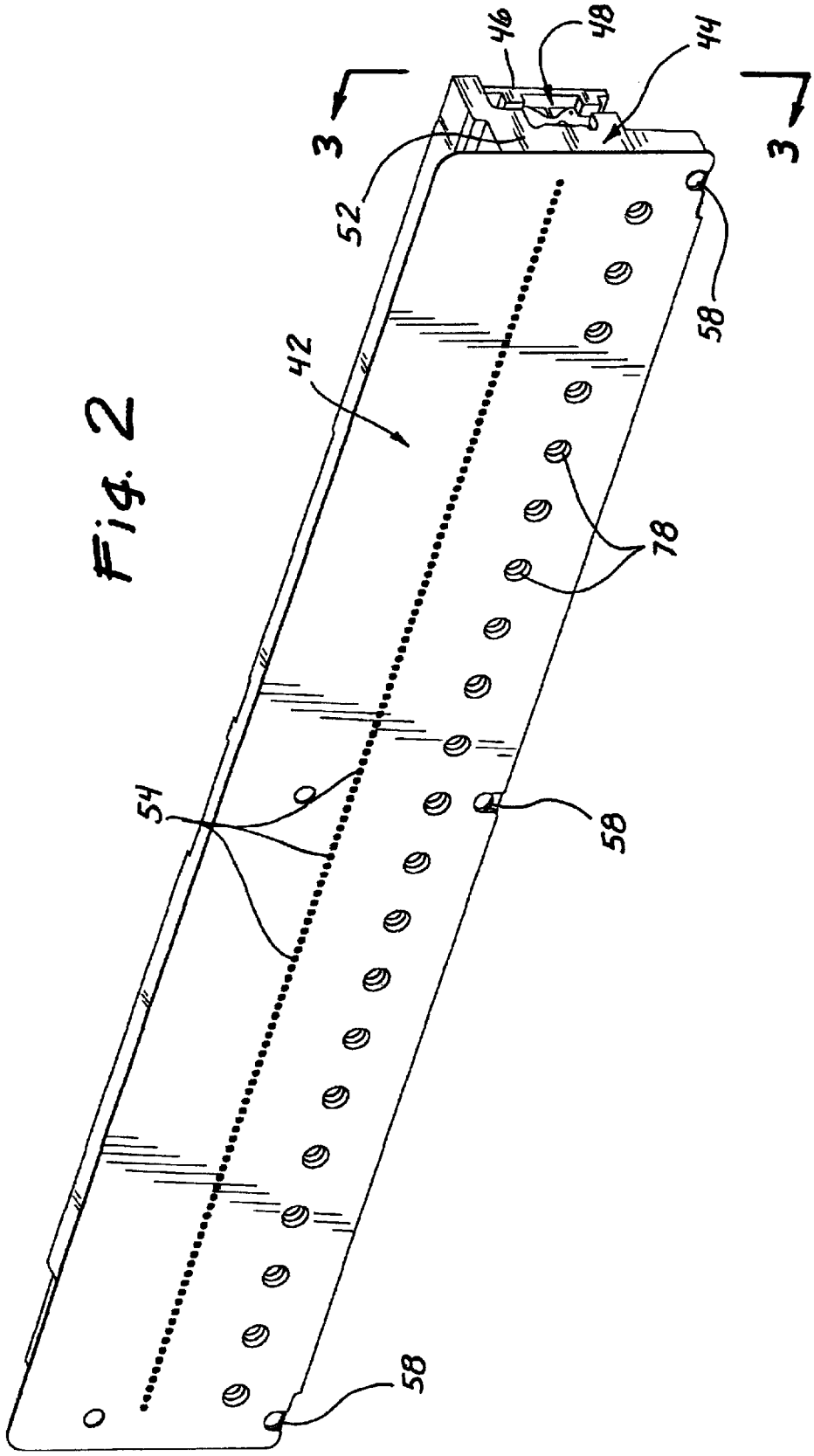
FIG. 2 shows a perspective elevation view of the line printer hammerbank and hammer cover as shown in the direction of lines 2—2 of FIG. 1.

FIG. 2 is a perspective view of the hammerbank 44 and the hammer cover 42. The elongated hammer cover 42 is shown overlaying a hammerbank 44 of which the end can be seen. The hammerbank 44 incorporates a hammer driver board 46. The hammer driver board 46 can incorporate a number of transistors, circuits, and processors as well as a power supply for driving and releasing the hammers.

The hammerbank 44 incorporates a plurality of bobbins with pole pieces and magnetics that are not readily seen in FIG. 2, but will be detailed hereinafter. These are generally shown as bobbins and pole pieces 48 which can be potted into a hammerbank mounting block, frame, support, carriage, or other securement and holding structure 52. The mounting block 52 is an elongated member that extends substantially along the length of the operational printer elements. It incorporates a number of hammers that are not seen in FIG. 2 that have tips that protrude when printing through openings 54. Openings 54 are formed in a screening portion which prevents the hammer tips from coarsely engaging the overlying ribbon which they strike.

Figure 3:
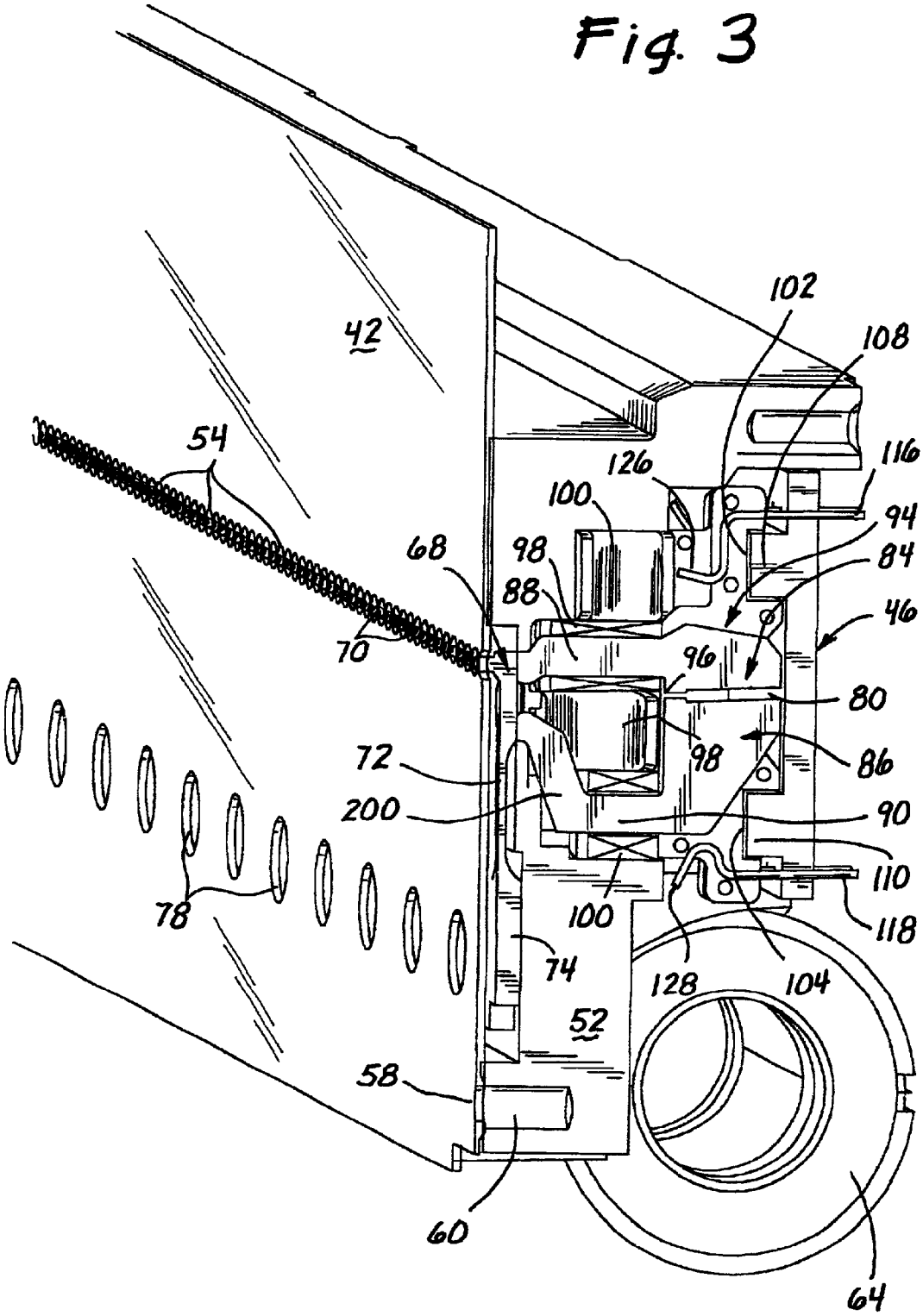
FIG. 3 shows a fragmented perspective end view of the line printer hammerbank of this invention in the direction of lines 3—3 of FIG. 2.

Looking more particularly at FIG. 3, it can be seen that a perspective end view in the direction of lines 3—3 of FIG. 2 has been shown.

FIG. 3 shows the hammer cover 42 with the plurality of openings 54 through which the hammer tips project for printing purposes. The cover 42 is attached at openings 58. Openings 58 receive a securement such as a threaded member, bolt, rivet, or other means for holding the cover 42 in place. The bolts are secured into a tapped opening 60 of the hammerbank support or block 52.

In order to move the hammerbank backwardly and forwardly or reciprocally, a drive lug 64 is provided. The lug 64 is connected to a mechanical drive in order to oscillate the hammerbank in a reciprocating manner. This allows the respective print hammer tips to strike in a programmed position on the media that is being printed.

The mechanical drive which drives the hammerbank can be seen in U.S. Pat. No. 5,666,880 to Gordon B. Barrus issued Sep. 16, 1997 as filed under Ser. No. 08/512,367 on Aug. 8, 1995 owned by the assignee of this application. The foregoing patent as to its mechanical drive and reciprocation of the hammerbank is hereby incorporated by reference as showing the mechanical drive features of this particular invention.

Looking again at FIG. 3, it can be seen that a hammer 68 of this invention has been shown that is provided with a tip 70 projecting from the cover 42. The hammer 68 incorporates a necked down portion 72 formed on an enlarged portion 74. The enlarged portion 74 is formed as a single piece on frets from which multiple hammers 68 are machined. The frets with the enlarged portion 74 can be secured to the hammerbank block 52 through openings 78.

Figure 5:
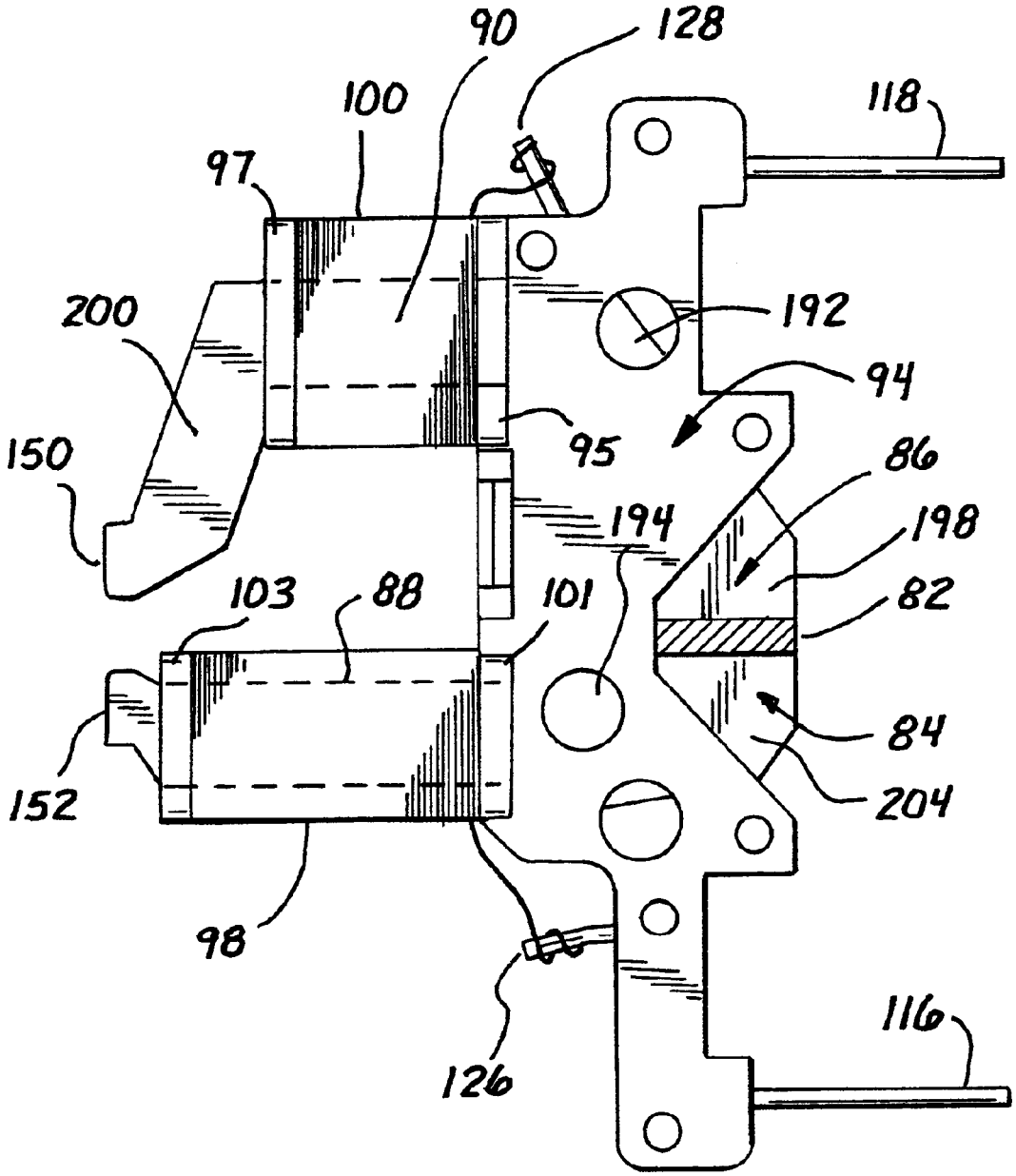
FIG. 5 shows a detailed side view of the pole pieces within a bobbin of this invention having windings therearound.

In order to magnetically retain the hammers 68 in their retracted position, a permanent magnet is emplaced within a slot 80. This permanent magnet can be seen in greater detail in FIG. 5. The permanent magnet 82 in FIG. 5 is shown within the slot 80.

Slot 80 is formed between two respective pole pieces 84 and 86. Pole piece 84 is formed generally as an elongated pole piece with a substantially longitudinally oriented portion 88 forming an arm, winding support, or extension. Pole piece 86 is formed with a C shaped, U shaped, dog leg, arched, arcuate, or other offset configuration to provide an intermediate portion 90 forming an arm, winding support, or extension. Intermediate portion 90 is removed from the relatively longitudinal portion 88 of pole piece 84. The removal can place it as a distal portion 90 from the proximal longitudinally oriented portion 88. The removal of the distal portion 90 can be offset, staggered, gapped, or spaced in any particular manner to allow a winding of a thicker coil thereon. In effect, the distal displacement between coils allows for greater width or breadth of coil windings on portion 90.

The two respective pole pieces 84 and 86 are held and maintained within a bobbin member, envelope, carrier, sheath, or holder 94 that is formed therearound. The bobbin member 94 can be a molded plastic configuration holding the pole pieces 84 and 86 together. Bobbin member 94 can be seen as a bobbin member having flanges, stops, disks, or spool ends 95 and 97 for winding the windings 100 therebetween shown in FIG. 4 in the entirety as well as in FIG. 5. Windings 98 are wound between stops, disks, flanges, or spool ends 101 and 103 extending at the end of a spool or in any other manner on the bobbin 94 to accommodate the windings 98 therebetween. Bobbin member 94 is shown in FIG. 3 as to its upper and lower portions but is hidden from view in part by the view showing the pole pieces 84 and 86.

The pole pieces 84 and 86 with the permanent magnet 82 emplaced in the slot 80 provides for a magnetic retention of the hammers 68. Each pair of pole pieces 84 and 86 retain one related hammer 68. The pole pieces 84 and 86 are provided with a magnetic shunt 96. The magnetic shunt 96 is configured to allow for applicable retention and release of the hammers 68 at a coil current less than that which would be required to cancel the field of the permanent magnet.

The elongated pole piece 84 with the proximal longitudinal intermediate portion 88 receives a winding or coil 98 therearound it. This coil 98 winds around portion 88 and forms a coil that can be electro-magnetically energized to create a force to overcome the permanent magnetism of the magnet 82. This electro-magnetic force of coil 98 works in conjunction with a second coil 100 which is wrapped around the intermediate, or straight distal portion 90 of the C shaped or dog leg shaped pole piece 86. These two respective pole pieces 84 and 86 act with their electro-magnetic coils 98 and 100 to overcome the magnetic circuit created by the magnet 82. The magnetic circuit passes through the pole pieces and the pole piece ends in cooperation with the hammer 68.

When the coils 98 and 100 are energized, they overcome the permanent magnetism of magnet 82. The hammer 68 is then released and can fire with its tip 70 against the ribbon 22 for impacting media to provide dot matrix printing thereon.

The bobbin 94 is molded such that it has indentations 102 and 104 in the bobbin. This allows the indentations to seat on raised portions that are elongated along the circuit board driver 46 namely raised portions 108 and 110.

In order to drive the electro-magnetics of the coils 98 and 100 around the respective pole piece portions 88 and 90, a coil connection lead 116 is connected to the winding 98 and a coil connection 118 lead is connected to the coil winding 100. These respective coil connections or leads are in turn formed to provide terminal connections to the electronics on the circuit board driver 46. The components on the circuit board driver 46 are hidden from view and can be seem more specifically in U.S. Pat. No. 5,743,665 to Ryan and Barrus issued Apr. 28, 1998, as filed under Ser. No. 08/807,575 on Feb. 27, 1997 which is incorporated herein by reference.

The respective coil leads 116 and 118 have extensions therefrom in the form of soldering leads 126 and 128. These soldering leads 126 and 128 connect the coils as described hereinafter to the respective coil leads 116 and 118.

Figure 4:
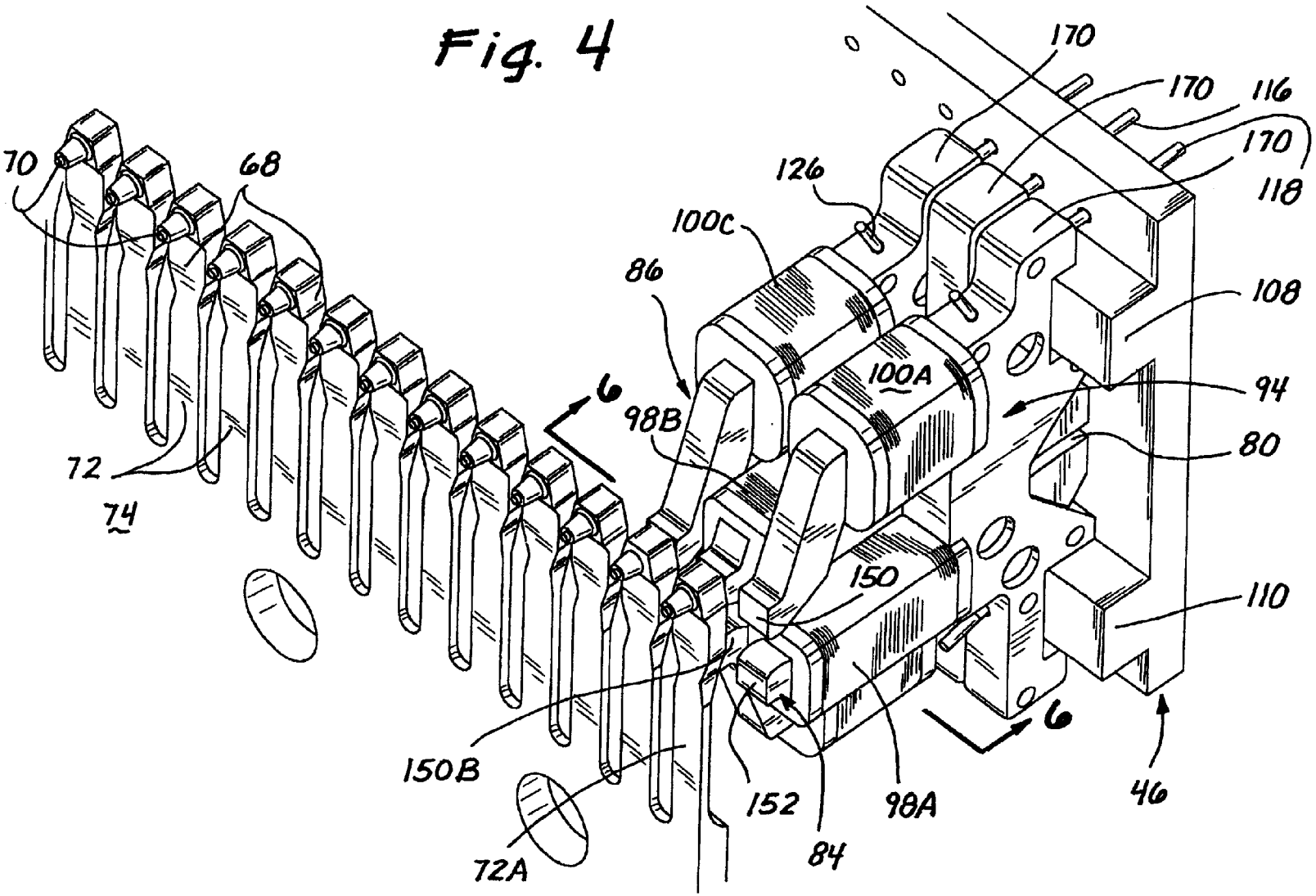
FIG. 4 shows a fragmented perspective view of the hammerbank of this invention detailing the hammers and some of their respective pole pieces and coils.

The showing in FIG. 4 gives an exemplary view of the coil 100 which is wrapped around the U shaped or dog legged pole piece 86 on the distal portion 90. These particular coils or windings 100 are wrapped in a manner so that they are thicker than the coils or windings 98 wrapped around the elongated or longitudinal proximal portions 88 of the pole piece 84. This is based upon the fact that the space or gap of the intermediate distal portion 90 between the ends of the U shaped portion of the pole piece 86 is not as long as that of the elongated longitudinal proximal portion 88 of pole piece 84. Thus, the coils or windings 98 are smaller in cross-section width or diameter than the coils or windings 100.

The foregoing relationship allows the coils 98 and 100 to be placed in close juxtaposition to its neighboring winding by virtue of the fact that the thicker winding 100 is displaced away from the thinner winding 98. Although both windings 98 and 100 can have approximately the same number of turns or length of wire with the same thickness of wire, winding 100 is thicker than winding 98. This thereby allows for greater density of windings to be emplaced on the respective pole pieces 84 and 86. When referring to thinner or thicker windings the term can relate to overall cross sectional thickness of width or breadth, when taken in either cross-sectional dimension. Also, breadth or width can be defined in either dimension and orthogonal to each other.

A key element is to have a pole piece with its winding in displaced, staggered, or removed relationship from an adjacent pole piece or winding to create a spatial relationship to accommodate greater numbers of coil windings. This spacing, staggering, or removal is asymmetrical as to varying spatial orientations between adjacent or neighboring pole pieces.

Looking more specifically at FIG. 4, it can be seen that coil 100 which has been designated 100A for clarification and specificity is shown overlying a longitudinally oriented coil 98 designated 98A for clarification. These two respective coils are wound on a pair of pole pieces having ends 150 and 152. Thus, they accommodate the hammer 72 that has been designated hammer 72A to pull it into proximity or in a retracted position by the permanent magnet 82 in the space 80.

The longitudinal or proximal coil within the next pair of pole pieces namely longitudinal coil 98B is shown in proximity to a lower or spatially removed or distal pole piece which is a dog legged, C shaped, U shaped, arcuate, or curved pole piece such as pole piece 86 having an end 150B. This in turn is wrapped with a thicker coil 100 in breadth and width on the distal winding arm or intermediate section 90.

Again, looking at the next set of pole pieces and windings, it can be seen that a thicker winding 100 is shown as winding 100C on a distal pole piece 86. This winding 100C is on the distal winding section or portion 90 of the C shaped pole piece 86. This in turn is matched with a longitudinally oriented winding 98 on the proximal pole piece winding arm or portion 88. The net effect is to have spatially oriented windings with pole pieces and their windings in closer proximity to each other based upon differing thicknesses, lengths, and displacement from a generally longitudinal orientation of the hammerbank, or orthogonal offsets therefrom. The relationship of distal and proximal pole pieces 84 and 86 with their windings can be rendered in other spatial orientations and geometries.

In the foregoing manner, it can be seen that the windings 100A and 100C when wrapped around the distal pole pieces 86 with their elongated portion, arm, or distal support 90 between the ends is wider or thicker than the windings 98 such as 98A and 98B on the proximal pole piece arms or supports 88. This is due to the fact that the windings 98 and 98B are longer and thinner when wrapped around the longitudinal or proximal portions 88 of pole piece 84. Tighter spacing between the respective coils 100A and 100C can be accommodated by the thinner spacing of coils 98A and 98B that provide for a like number of windings but have been longitudinally extended along the length of the proximal pole piece 84 on the longitudinal arm or proximal support portion 88.

The foregoing staggered, asymmetric, or alternating winding spatial relationship creates a closer spacing of the windings. The closer spacing of the windings allows for greater utilization of a given size printer hammerbank. The lesser magnetic interaction and the overlapping are such where a greater number of coils can be placed within a given length of the hammerbank. For instance, one hundred and twenty six (126) print hammers as opposed to one hundred and two (102) can be placed on a thirteen and one half (13½) inch hammerbank. This is approximately a twenty five percent (25%) increase in hammers.

Since coil losses are a substantial portion of the power loss, this enables a manufacturer to incorporate a larger gauge wire with fewer windings or a lesser gauge wire with greater windings with respect to each coil 98 and 100.

With the effect of lesser magnetic interaction, it has also been found that the pole pieces need not be laminated. Lamination can be a positive factor in helping to eliminate eddy currents in the pole pieces 84 and 86. However, it has been found with this improved winding scheme that the pole pieces can be made from a single piece of metal or merely two laminations rather than the multiplicity of laminations that were used in the prior art. This enables the usage of a cheaper material and a cheaper process to manufacture the pole pieces.

When looking at FIG. 4 again, it can seen that the bobbins 94 as shown are made from two pieces having a parting line 170. These parting lines 170 allow for partial enclosure, or encapsulation of the pole pieces 84 and 86. The terminals 116 and 118 can be emplaced within the thicker portion. The two portions merely need be molded with a groove in one portion and overlayed with the other portion respectively the thicker and thinner portions as shown along the part line 170. The terminals 126 then extend through the thicker section of the bobbins 94 so that they are relatively tangent to the part lines 170.

A showing of the bobbin 94 and a respective inter relationship can be seen in FIG. 5. In FIG. 5, it can be seen that the bobbin 94 is shown with the U shaped distal or arcuate pole piece 86 in proximity to the longitudinally oriented or proximal pole piece 84.

The wire lead 118 that interconnects the circuit board and drivers 46 terminates in the soldering lead 128 that is shown having a wire connected to the thicker coil 100.

The lead 116 is connected to a second soldering lead 126 for interconnecting the elongated or longitudinal coil 98. These respective leads allow for interconnection and orientation of the windings 98 and 100 on their respective pole pieces.

In order to enhance winding of the bobbin 94, a pair of winding bosses, protuberances, or in the alternative openings 192 and 194 are shown which can be grasped by jaws for winding the respective windings forming coils 98 and 100.

Looking more specifically at the orientation of the pole piece forming distal pole piece 86, it can be seen that a first enlarged base portion, expanded element, or thicker portion 198 is shown which terminates in the winding arm, or distal winding support 90. The distal arm 90 extends to an angularly extended elongated terminal end 200 which terminates in the pole piece end 150. Any particular configuration for the distal pole piece 86 can be utilized such as a U shape, a C shape, a rounded curvilinear arcuate portion, a V shape, angular portion, or any other configuration in order to displace the distal winding 100 on its distal arm 90 away from the proximity of the lower proximal coil 98 or an adjacent coil.

Looking more specifically at the proximal pole piece 84, it can be seen that it comprises a slightly larger portion 204 that extends as a base, enlargement, or support member analogous to portion 198 of pole piece 86. This particular portion of the proximal pole piece 84 extends to the respective arm, winding support, or extension 88 which in turn terminates at a pole piece end 152. The two respective pole piece ends 150 and 152 provide for the provision of permanent magnetism to the hammers 68 and also receive the electro-magnetic force through the coils 98 and 100 when actuated by the drivers on the circuit board 46.

The relatively elongated or longitudinal orientation of the proximal arm 88 enhances in width or other dimensions if desired, a closer proximity to an adjacent distal coil such as coil 100 which is shorter and thicker in width. The two relative windings 98 and 100 can be of a relatively equal number of turns, length, or have the same proximate amount of conductive material such as the copper in the wire.

Depending upon electro-magnetic design and flux considerations, the coils can have relatively different numbers of windings to effect different magnetic reactions through the pole pieces 84 and 86 and their respective pole piece ends 150 and 152. For this reason, the flexibility of having variably sized windings on the winding arms or supports 88 and 90 create electro-magnetic and permanent magnet design capabilities not capable in the prior art. At the same time this invention permits increased and closer proximity of the respective pole pieces and windings.

Figure 6:
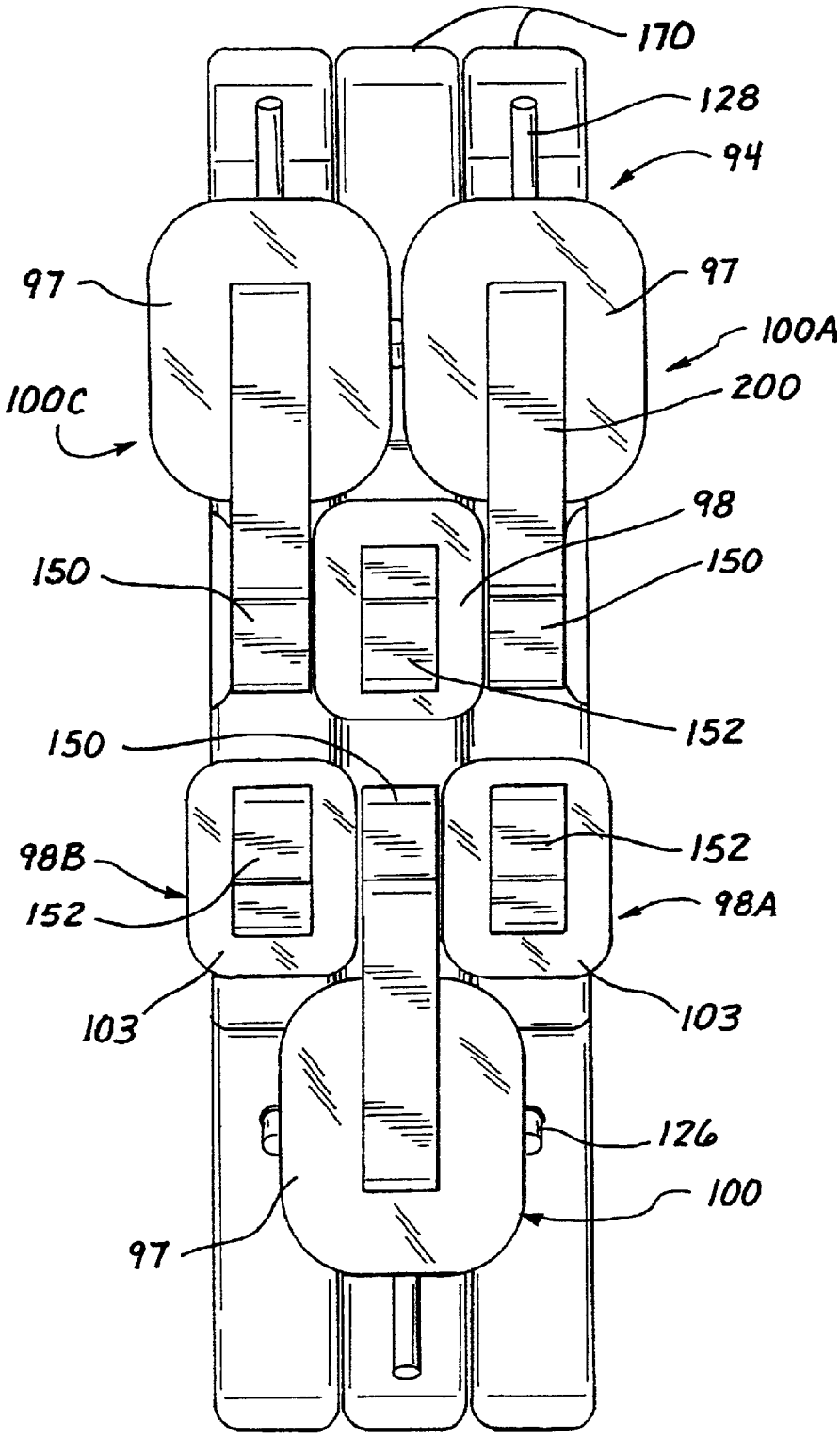
FIG. 6 shows a front elevation view as taken in the direction of lines 6—6 of FIG. 4.

Looking more specifically at FIG. 6 the respective frontal portions of the pole pieces 84 and 86 and the bobbin 94 can be seen. In this particular showing of FIG. 6, it can be seen where the coils 98 and 100 accommodate the close proximity, staggered, or spatially improved relationship. As seen from the frontal view of FIG. 6, coils 98 and 100 when placed in staggered, offset, or displaced juxtaposition to each other are enhanced. Proximal coil 98 is an elongated coil with lesser thickness while distal coil 100 is a shorter coil with greater thickness. Thickness can be measured cross-sectionally as to either breadth or width of the coils.

Any particular configuration to stagger, provide for asymmetry, distally and proximally orient, or provide for other offset adjacent relationships for the respective coils 98 and 100 can be incorporated. As previously stated, generally V shaped configuration, curved portion, arcuate portion, or other elements can be utilized to accommodate the respective distal coil windings. Also, the support arms 88 and 90 for the proximal and distal windings on the pole pieces need not be planar, longitudinal flat, and/or straight. The supports 88 and 90 can accommodate various configurations such as a curved configuration, arcuate configuration, or other portion to match a related, adjacent curved or arcuate portion. In effect the dimensions can vary as to cross-section in the longitudinal direction of the hammerbank.

Various accommodations will be apparent to one skilled in the art depending upon the geometry as desired for proper orientation. Greater variations in width, breadth, and length of adjacent coils for adjacent pole pieces are effected by this invention. This makes the adjacent relationships accommodate each other with regard to staggered, offset, angular, arcuate, or other relationships to place coils in closer proximity to each other.

What is claimed is:

1. A line printer comprising:

a hammerbank with print hammers arrayed in adjacent relationship along said hammerbank having tips for impacting a print ribbon to print on an adjacent media;

a permanent magnet for retaining said print hammers;

a first pair of pole pieces in a magnetic circuit wherein said pole pieces of the first pair each have an end in associated relationship with one of said hammers with one pole piece of the first pair having a different configuration than the other pole piece of the first pair;

a second pair of pole pieces in a magnetic circuit wherein said pole pieces of the second pair each have an end in associated relationship with a second one of said hammers with one pole piece of the second pair having a different configuration than the other pole piece of the second pair, and wherein the second one of the pole pieces of the second pair located directly adjacent and between the first pair of pole pieces; and coils wrapped around each of said pole pieces.

2. The line printer as claimed in claim 1, wherein:

said coils on said first pair of pole pieces are of differing width.

3. The line printer as claimed in claim 1, wherein the one pole piece of the first and second pairs have approximately the same dimensions and the other pole piece of the first and second pairs have approximately the same dimensions.

4. The line printer as claimed in claim 1, wherein the coils around the one pole piece of the first and second pairs are wider than the coils around the other pole piece of the first and second pairs.

5. The line printer as claimed in claim 1 wherein:

said first and second pairs of pole pieces are staggered as to configuration or size along said hammerbank.

6. The line printer as claimed in claim 5 wherein:

said coils on said first pair of pole pieces are of differing thickness.

7. The line printer as claimed in claim 5 wherein:

said coils on said first pair of pole pieces are of differing length.

8. The line printer as claimed in claim 5 wherein:

one of said pole pieces from the first pair has a generally U shaped configuration; and, the other of said pole pieces from the first pair has a generally longitudinally shaped configuration.

9. The line printer as claimed in claim 1, wherein the coil around the one pole piece of the first pair is thinner than the coil around the other pole piece of the first pair.

10. The line printer as claimed in claim 1, wherein the coil around the one pole piece of the first pair is longer than the coil around the other pole piece of the first pair.

* * * * *